United States Patent [19]

Coester

[11] Patent Number: 4,774,891

[45] Date of Patent: Oct. 4, 1988

[54] SYSTEM FOR PNEUMATIC PROPULSION OF VEHICLES

[76] Inventor: Oskar H. W. Coester, Rua David Francisco Maurício, 85 90.000 Porto Alegre - RS, Brazil

[21] Appl. No.: 888,464

[22] Filed: Jul. 18, 1986

[30] Foreign Application Priority Data

Jul. 19, 1985 [FR] France ..... 85 03504

[51] Int. Cl.[4] ..... E01B 25/00

[52] U.S. Cl. ..... 104/130; 104/140; 104/155; 246/419

[58] Field of Search ..... 104/130, 155, 156, 138.1, 104/139, 140, 141; 246/419, 274, 415 R, 417, 435 R, 449, 452; 406/183, 184; 251/326, 327; 137/630.12

[56] References Cited

U.S. PATENT DOCUMENTS

| | | | |
|---|---|---|---|
| 356,865 | 1/1887 | Bryson, Jr. et al. | 406/183 |
| 667,508 | 2/1901 | Edwards | 246/419 X |
| 680,843 | 8/1901 | Comstock | 104/156 |
| 747,774 | 12/1903 | Ritter | 246/419 |
| 824,354 | 6/1906 | Green | 246/452 X |
| 3,610,163 | 10/1971 | Edwards | 104/156 |
| 3,701,496 | 10/1972 | Ekama | 406/183 |
| 4,108,079 | 8/1978 | Carstens et al. | 104/156 X |
| 4,587,906 | 5/1986 | Coester | 104/156 |
| 4,658,732 | 4/1987 | Coester | 104/156 |

FOREIGN PATENT DOCUMENTS

| | | | |
|---|---|---|---|
| 17703372 | 5/1977 | Brazil . | |
| 0012710 | 7/1903 | Fed. Rep. of Germany | 104/140 |
| 2808725 | 9/1979 | Fed. Rep. of Germany | 104/130 |
| 0014452 | of 1892 | United Kingdom | 246/419 |
| 1169913 | 7/1985 | U.S.S.R. | 406/183 |

*Primary Examiner*—Robert B. Reeves
*Assistant Examiner*—Scott H. Werny
*Attorney, Agent, or Firm*—Ostrolenk, Faber, Gerb & Soffen

[57] ABSTRACT

Cargo and passenger vehicles are pneumatically propelled by a system comprising a bifurcated rail module assembled on a beam, for establishing two alternative routes for the rail network, according to a position adopted by line changing equipment. Switch points in the rails are synchronized by an actuator located below the beam, the motion of which is transmitted by torque tubes that drive the switch points. The control motion of the switch points is transmitted further by connecting rods located below the beam, to a torque tube that moves segments of articulated rail for clearing the passage of driving vanes connected to the vehicle through a longitudinal slot in the beam, in the same direction established by the position of the switch points of the line changing equipment. Stop valves for the module are provided in the two bifurcated ends of the duct for interrupting the flow in the portion of the line not selected by the line changing equipment. The stop valves may comprise two mobile panels moved by actuators, the assembly being installed in the space between any two beams of the rail network or, alternatively, may comprise a retractable panel placed below the beam which rises through an opening in the lower plane of the beam to efficiently block the flow of air in the duct.

10 Claims, 7 Drawing Sheets

SYSTEM FOR PNEUMATIC PROPULSION OF VEHICLES

BACKGROUND OF THE INVENTION

1. Field of the Invention

This invention relates to improvements in a system of pneumatic propulsion of cargo and/or passenger vehicles, aimed at improving their physical and functional characteristics, assuring to this system a highly favorable performance in the transportation of cargo and/or passengers.

2. Description of Related Art

A system for pneumatic propulsion of cargo or passenger vehicles is known from Brazilian Patent of Invention No. 7.703.372 filed on May 25, 1977. That system comprises a tube fitted with a longitudinal slot, with a sealing system, through which passes a rod that fastens a set of vanes to the chassis of the vehicle, supported by the tube, the drive being accomplished by means of a flow of high speed air, acting on the set of vanes, displacing the same and, consequently, moving the vehicle freely, through adequate devices, whereby movement generated by stationary sources outside the vehicle is made possible. This system further has brakes which act directly on said devices, and special conduits to accommodate a telephone network. Accordingly, this aforementioned pneumatic drive system is characterized by the pneumatic propulsion of vehicles, powered by stationary power sources. The purpose of the system is to provide an urban transportation system dimensioned to meet current and future requirements; to render compatible in only one concept, optimum characteristics for vehicles, rail network and terminals; and to make significant improvements in the economic performance, speed, regularity, comfort and safety of urban transportation at reduced cost.

A further system for pneumatic propulsion of cargo or passenger vehicles is known from Brazilian Patent of Invention No. 7.906.255 filed on Sept. 28, 1979, that system comprising, among other improvements, valves that make it possible to stop and control the stopping of the vehicle, and to continue the displacing of the vehicle on the route, comprised by the station, as stated in claim No. 15 of said Patent of Invention.

Further improvements in a pneumatic driving system for cargo or passenger vehicles are known from Brazilian Patent of Invention No. 8.301.706 filed on Apr. 4, 1983, comprising, among other improvements, stop valves for the propulsion air duct, for the purpose of blocking or freeing the propulsion air duct, as stated in claim No. 6 of said Brazilian Patent of Invention.

BRIEF DESCRIPTION OF THE INVENTION

The present invention relates primarily to devices by which a vehicle that travels on the rail network of a pneumatic propulsion system can be switched from one line to another. It comprises the structure of a propulsion air duct in the area in which switching takes place, and also the switching devices by which the desired line is selected at a bifurcation of the rails.

The present invention further relates to improvements in the stop valves of the propulsion duct, for closing or opening the propulsion duct for the passage of the flow of driving air.

In one embodiment of the invention, the valves act by lateral transfer of flat panels guided in a rigid, sufficiently slim frame to allow the insertion of the set in the space between two beam modules, not needing special openings in same. In another embodiment, one panel placed below one opening of the propulsion duct, and jointed on one end, is displaced upwards until it completely obstructs the duct.

DESCRIPTION OF THE PREFERRED EMBODIMENTS

Figure 2:
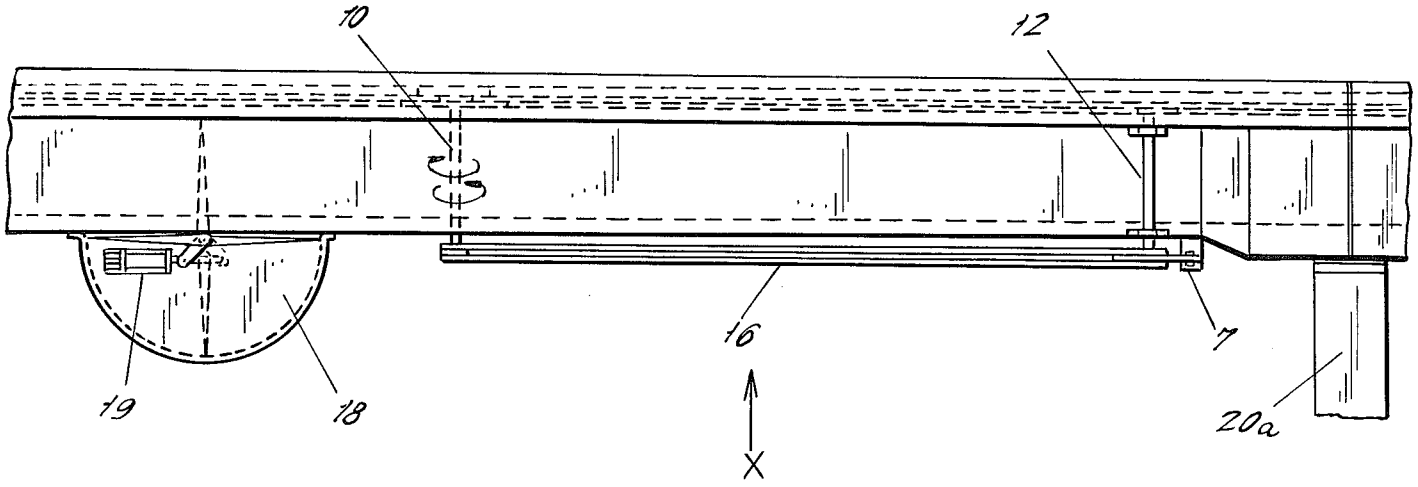
FIG. 2 is a side view of the same structure and devices as in FIG. 1, and also showing the supporting pillars, the propulsion duct, and a stop valve of the arrangement described in Brazilian Patent of Invention No. 8.301.706.

In the above mentioned figures there is seen a concrete or steel beam 1 of modular construction in the form of a bifurcation and supported by pillars **20*a* (FIG. 2). On the beam 1 are laid pairs of rails 3 and 4, which are the network for the transportation system under consideration. On the inside of the beam 1 are propulsion air ducts for propelling a vehicle. A longitudinal slot 2 in the upper plane of the beam 1 provides free passage to the rod of the driving plate of the vehicle. In the section of bifurcation shown, the line bifurcates according to two paths AB and AC, equipped with respective pairs of rails 3 and 4. The longitudinal slot 2** also bifurcates, according to paths AB and AC, at a point "Y".

Line changing equipment is mounted on the beam 1 for selecting the alternative paths AB or AC for the rail network, thus creating continuity of the rails on the selected path and preventing any obstruction caused by the crossing of the rails. At the same time, free passage of the propulsion rod through the slot 2 in the selected direction is assured.

For these purposes, mobile segments of rails 5 of special shape, which shall be called switch points, articulate on the points 6 and are moved synchronism by a linear actuator 7 through the arm 14, torque tubes 12 and articulated connecting rods 15. The movement of the torque tubes 12 is synchronized by the action of a pair of adjusting rods 13.

At the same time and in synchronism with the switch points 5, a pair of rail segments 8, articulated at the points 9, shift to cause the propulsion rod of the vehicle to pass through the slot 2 into the path defined by the position of the switch points 5 for the rail network. For that purpose the rotating motion of the torque tubes 12 is transmitted to a torque tube 10 by synchronizing rods 16, the motion of the torque tube 10 being transmitted to the segments 8 through the rods 11, thus assuring a perfect synchronism of movement and coincidence of positions between the switch points 5 and the segments 8. A further mobile rail segment 20 (FIG. 1) turns with the torque tube 10 so as to reach a position which assures continuity to the rails of the way in use, while, at the same time, its movement liberates space for passing of the wheel flange through the crossing with the rail of the non-selected way.

Figure 1:
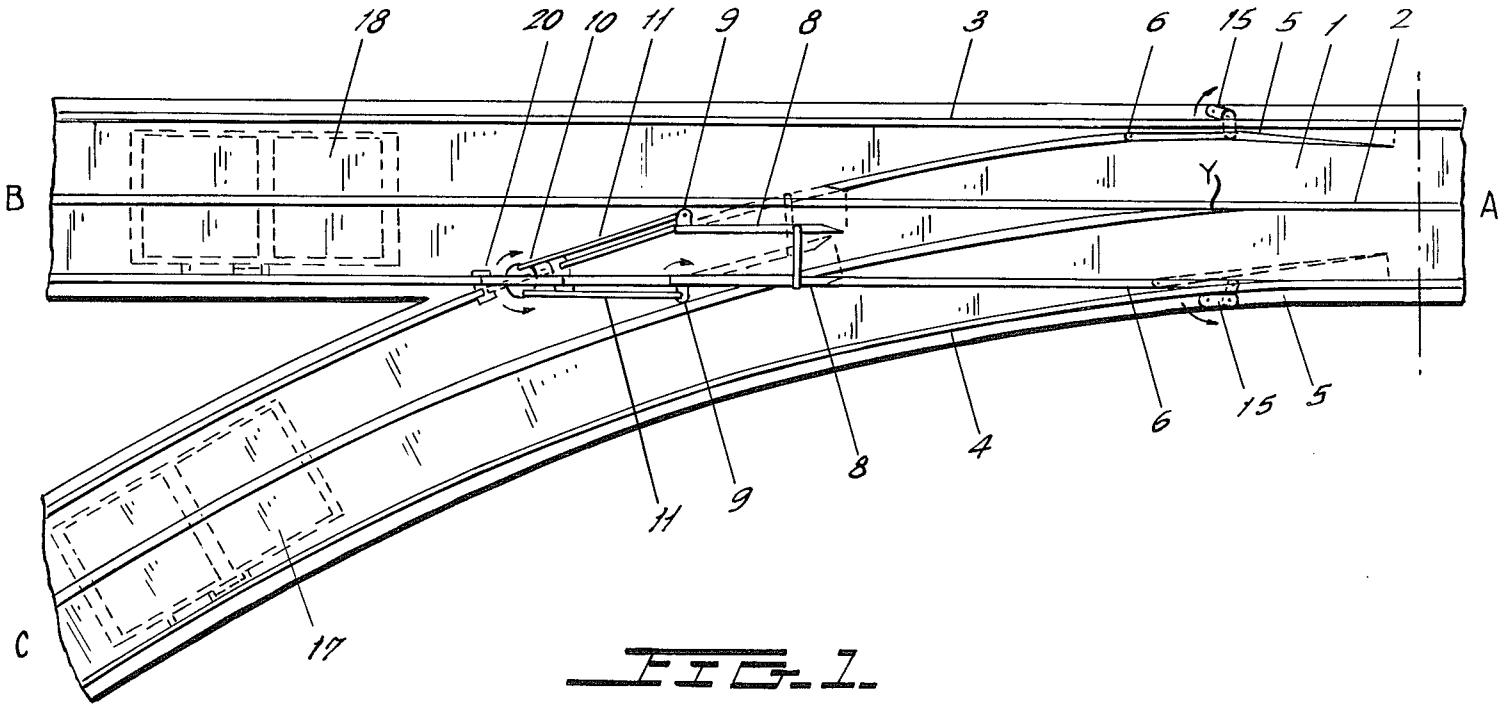
FIG. 1 is a view from above of the structure of the propulsion duct in the area in which switching between lines is carried out, including the rails of the rail network of the transportation system, and the switching devices, by which the desired route is selected at a bifurcation of the rails.
Figure 3:
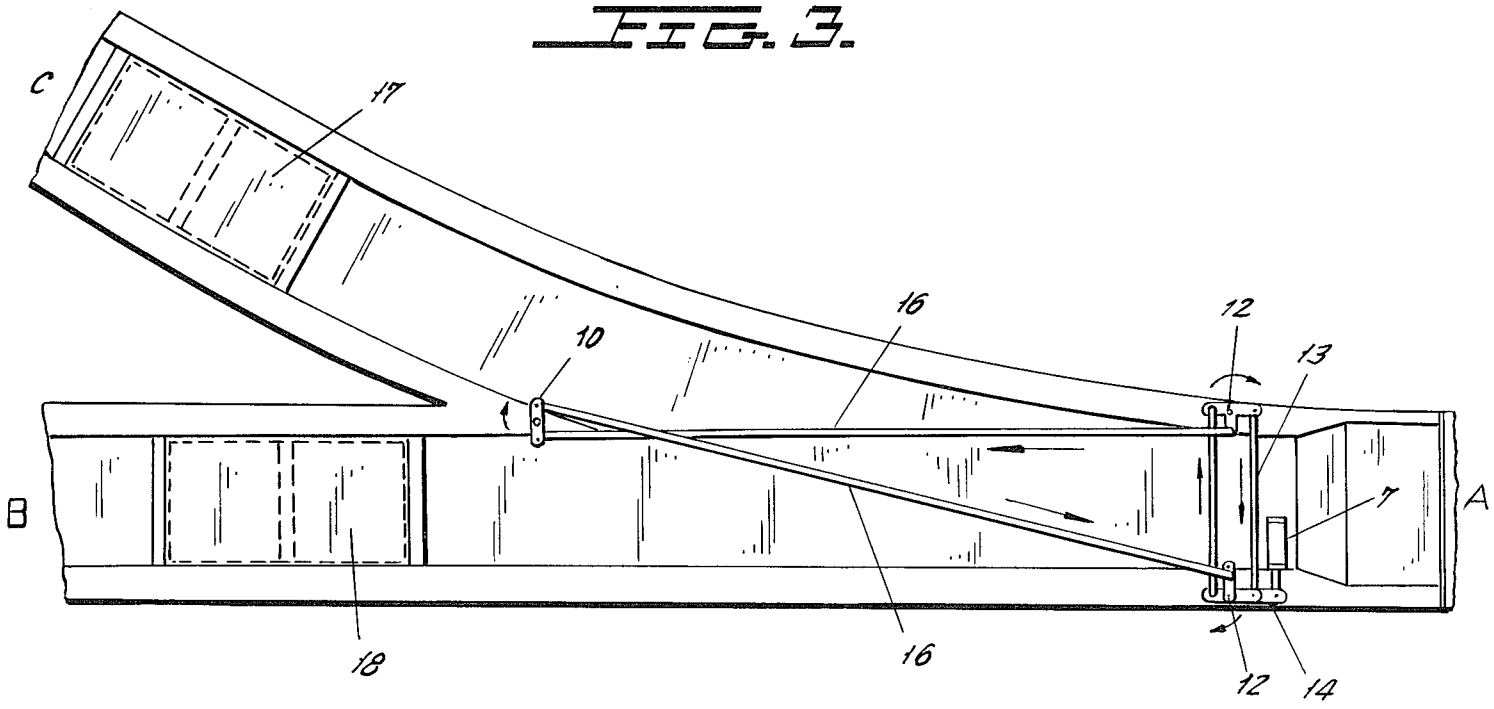
FIG. 3 is a view from below, of the same assembly as in FIGS. 1 and 2.

Still referring to FIGS. 1–3, the rotating plate of the stop valves 17 and 18 installed at the B and C ends of the bifurcation module of the line is moved by actuating cylinders 19. The position of the valves determines which way, AB or AC, shall be energized by the flow of driving air in coincidence with the way selected by the line changing equipment. For example, when the line changing equipment selects the AB way, valve 18 is placed in the open position, giving passage to the flow of driving air in the AB section of the propulsion duct. Simultaneously, the valve 17 is placed in the closed position, obstructing the passage of air in the AC section of the propulsion air duct. The actuators 7 and 19 are controlled jointly by an electric circuit which provides for reciprocal blockage, assuring that the position taken by the three actuators is always coherent.

Figure 4:
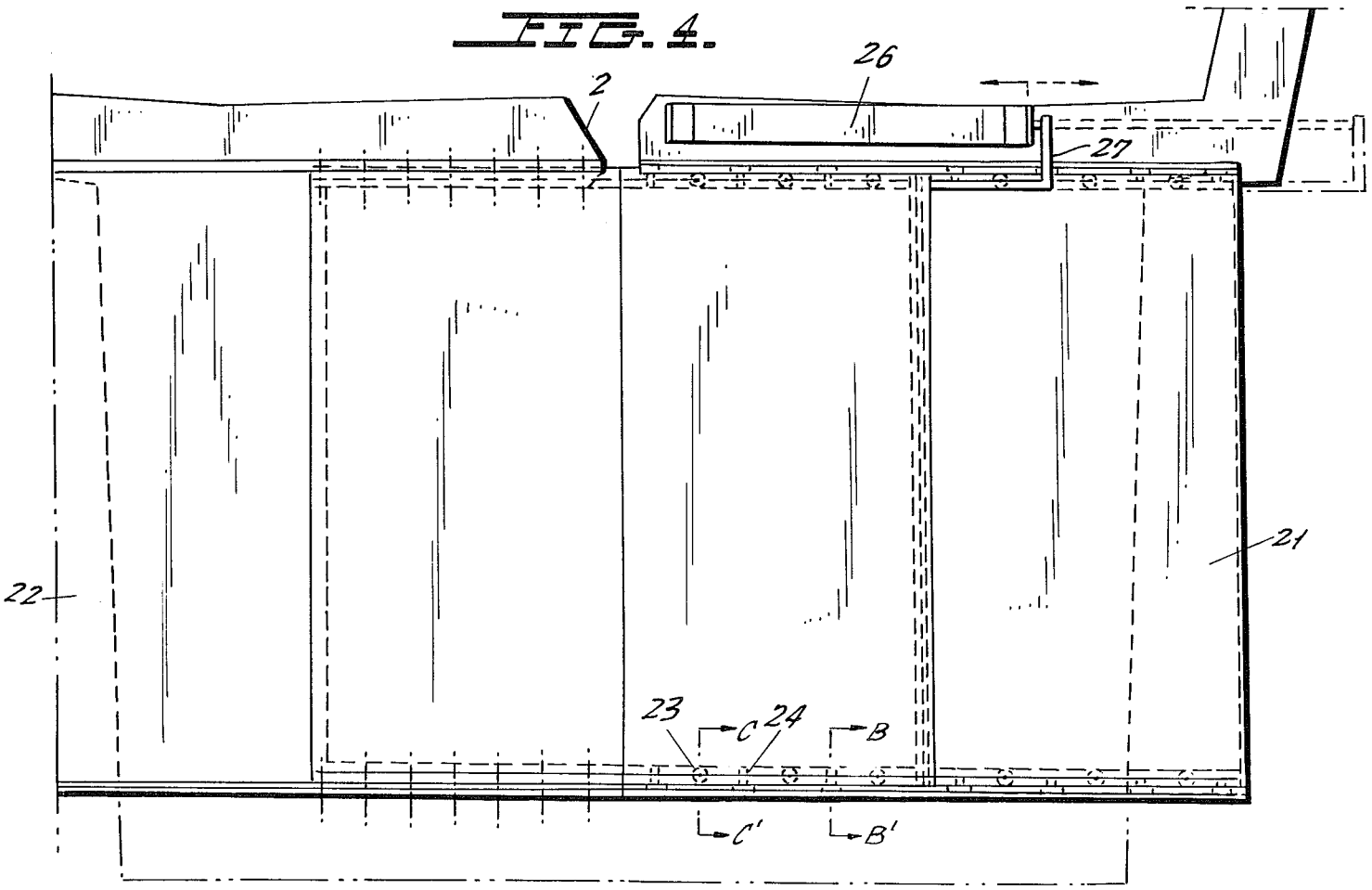
FIG. 4 is a front view showing the structure of the propulsion duct, with a stop valve installed on the same with an opening for lateral translation of the flat panels.
Figure 5:
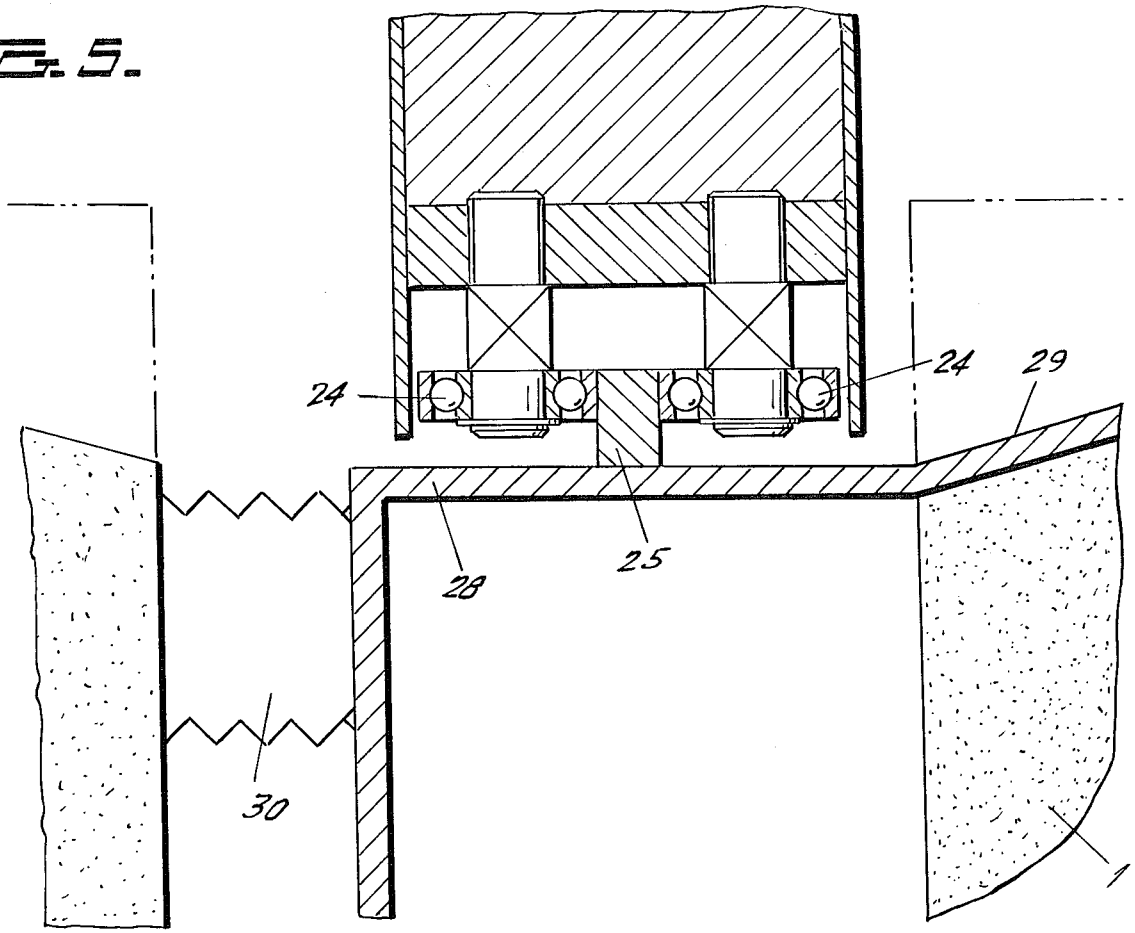
FIGS. 5 and 6 are cross-sectional views taken respectively along lines B—B′ and C—C′ of FIG. 4, showing enlarged details of the rolls that support the flat panels in their translation motion.
Figure 6:
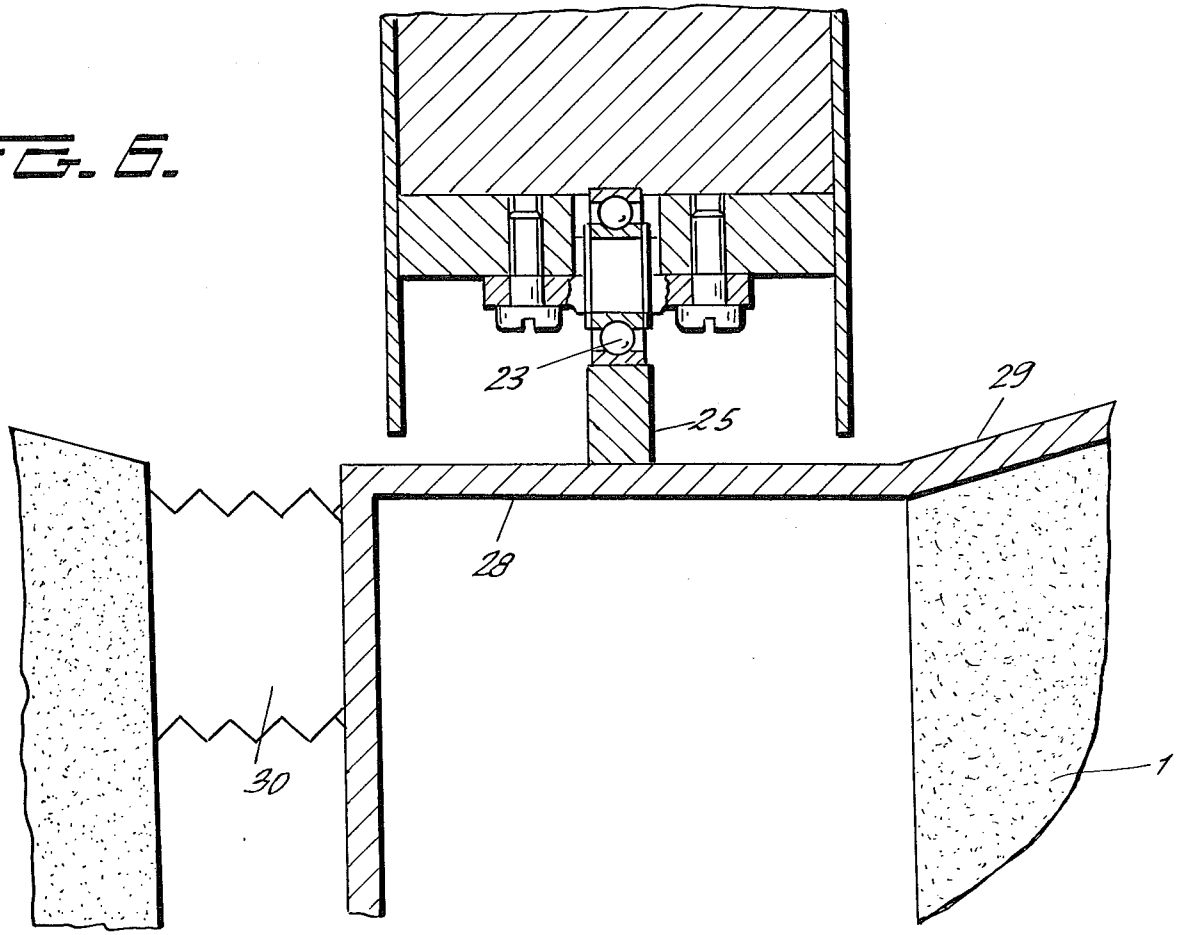

FIGS. 4–6 show another embodiment of a stop valve of the line, having the same general purpose as the valves 17 and 18 as mentioned above, and comprising two flat panels 21 and 22 which move on rolls 23 (e.g., ball bearings) which bear upon rails 25 provided on the upper and lower sides of the panels 21 and 22, running transversely to the propulsion air duct 2, in such a way that, in closed position, the flat panels 21 and 22 touch at their edges and obstruct transversely the propulsion air duct, efficiently blocking the air flow in the duct, while, at the other end of their translation, the flat panels mentioned do not interfere with the space of the propulsion air duct and thus allow for free air flow inside same. Pairs of transverse rolls 24 (e.g., ball bearings) lay against sides of the rails 25 for guiding the panels in the lateral sense.

A pair of actuators 26 move the flat panels 21 and 22 to which they are linked by the arms 27. In turn, the upper and lower rails 25 are fastened to the outside frame of the top valve, their rim 29 fitting into and fastened in the internal perimeter of the propulsion air duct 2. Thus, the stop valve assembly is fastened to the end of a propulsion air duct module, occupying in the assembly of the line the free space between two adjacent modules, and being separated at the end of the module to which it is not directly linked, by an expansion joint 30.

Figure 8:
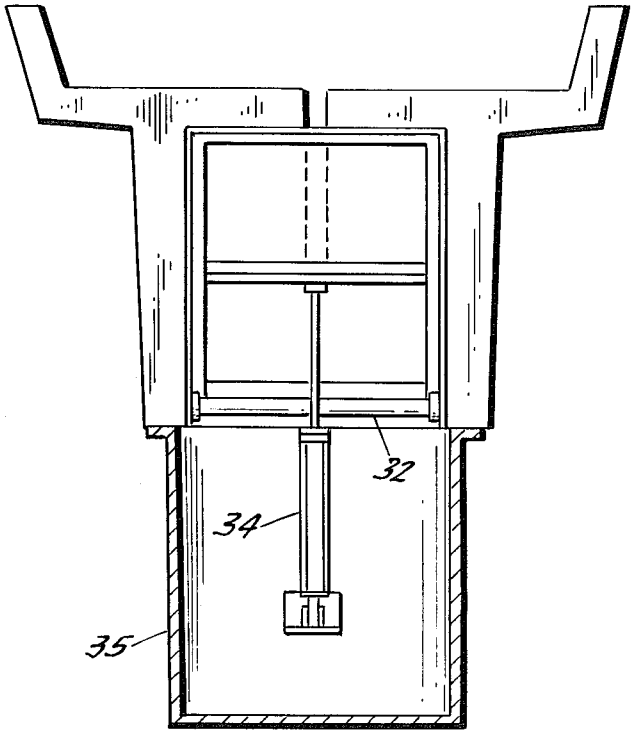
FIG. 8 is a cross-sectional view taken along line A—A′ of FIG. 7.
Figure 7:
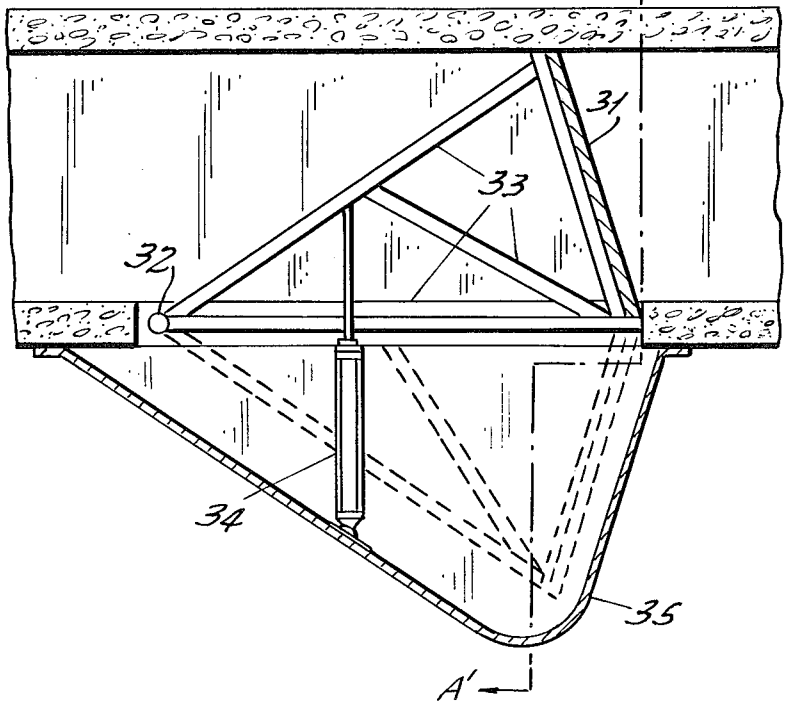
FIG. 7 is a front view showing the structure of the propulsion duct showing a stop valve of the rising panel type.

FIGS. 7 and 8 show another embodiment of a stop valve of the line, having the same general purpose as the above mentioned valves 17 and 18, in which a flat panel 31 is displaceable from one selected position as shown in FIG. 7 by dotted lines, to an extended position as shown in FIG. 7 with solid lines. For that purpose the panel is linked to a rotating shaft 32 through a lattice structure 33. The panel assembly 31 with structure 33 moves around the shaft 32 When driven by the actuating cylinder 34. An external box 35 assures the sealing of the propulsion air duct 2.

Although the invention has been described herein with respect to specific embodiments thereof, it is to be understood that the invention is not limited to such embodiments. Rather, modifications and variations may occur to one of ordinary skill in the art within the scope of the invention, as defined in the claims.

I claim:

1. A system for pneumatic propulsion of a vehicle, comprising:

a bifurcated module which includes a base beam with a propulsion air duct therein and rails thereon, said rails including a common rail pair and first and second bifurcated rail pairs, which selectively communicate for providing two alternate paths for said vehicle;

said bifurcated module further comprising a common guide slot and first and second bifurcated guide slots, said slots being between said common rail pair and first and second bifurcated rail pairs, respectively, for guiding the vehicle along the respective rail pair and for passage of a rod connecting a propulsion plate in the air duct, to the vehicle;

line changing means for selectively and synchronously communicating the common rail pair with one of the first and second rail pairs, said line changing means including a first pair of mobile rail segments driven by articulated connecting rods, which in turn are driven by an actuator located below the beam via torque tubes which are interconnected and extend from below the beam to said articulated connecting rods, which transmit the motion of the actuator to said articulated connecting rods;

guide switch means including a second pair of mobile rail segments for selectively guiding said vehicle from the common guide slot to one of the first and second bifurcated guide slots, said second pair of rail segments being driven in synchronism with said first pair by a torque tube extending from below the beam and which is driven in turn by a pair of synchronizing rods below the beam which are connected to said actuator; and stop valve means associated with said first and second guide slots, and interconnected with said above-mentioned actuator, for selectively and synchronously blocking the one of said first and second guide slots to which said vehicle is not being guided.

2. A system as claimed in claim 1, wherein said first pair of mobile rail segments are synchronized and kept parallel by a pair of respective torque tubes interconnected by adjusting rods, a translation motion of the actuator being converted into a rotating motion of an arm of one said torque tube associated with this arm, said rotating motion being transmitted by the adjusting rods to the other torque tube symmetrical to the first one, the rotating motion of the torque tubes performing a translation movement of the first pair of mobile rail segments by action of the articulated connecting rods.

3. A system as claimed in claim 1, wherein said second pair of mobile rail segments have a rotative motion which selectively causes the propulsion plate of the vehicle to pass through the guide slots, the motion of said second pair of mobile rail segments being synchronized between themselves and with the motion of the first pair of mobile rail segments through said synchronizing rods and said torque tube associated therewith, and a pair of respective connecting rods, in such way that, when the actuator controls the first pair of mobile rail segments to take a position corresponding to a path of the rail network, the second pair of mobile rail segments are concomitantly moved to cause the passage of the propulsion plate through the slot of this same path.

4. A system as claimed in claim 1, and further characterized by third mobile rail segment means rotated by the torque tube associated with the second pair of mobile rail segments, with movement synchronized with the movement of the first pair of mobile rail segments, for providing continuity of the rail pair being used, near a rail crossing of said rail pair.

5. A system as claimed in claim 1, wherein said connecting rods, torque tubes, and synchronizing rods assure synchronized motion of all components of the line changing means and guide switch means, said connecting rods, torque tubes, and synchronizing rods being the only means for assuring synchronized motion.

6. A system as claimed in claim 1, wherein said stop valve means comprise stop valves which function in synchronism with the movement of the line changing means, so as to leave free passage for the air flow on the path established by the line changing means and to close the passage of the air flow in the alternative path, all in order to energize the propulsion duct of the path selected by the line changing means and to deenergize it in the non-selected path.

7. A system as claimed in claim 1, wherein said stop valve means comprise an arrangement of line stop valves comprising flat panels which move transversely to the longitudinal axis of the propulsion air duct on rolls and rails, being translated by actuators in such way that, in one end position the panels touch each other, obstructing the duct and efficiently blocking the propulsion air flow inside the same, while at another end position the flat panels clear the section of the propulsion air duct completely, allowing for free flow of air through it.

8. A system as claimed in claim 1, wherein said stop valve means comprises an essentially flat stop valve which is placed substantially at an edge of the beam which comprises propulsion air duct, a portion thereof being fastened to the propulsion air duct of a given beam, and the free space adjacent the stop valve being provided with an expansion joint for connecting said stop valve to a further beam.

9. A system as claimed in claim 1, wherein said stop valve means comprises a stop valve comprising a flat panel articulated around a shaft by a lattice structure, the panel being placed inside a case fastened below the beam, thus remaining in a retracted position, in which the air duct inside the beam stays substantially fully unhindered, and said panel being movable upwards through an opening in a lower portion of the beam, by the action of an activating cylinder, until completely blocking the air flow inside the air duct.

10. A system for pneumatic propulsion of a vehicle, comprising:

a bifurcated module which includes a base beam with a propulsion air duct therein and rails thereon, said rails including a common rail pair and first and second bifurcated rail pairs, which selectively communicate for providing two alternate paths for said vehicle;

said bifurcated module further comprising a common guide slot and first and second bifurcated guide slots, said slots being between said common rail pair and first and second bifurcated rail pairs, respectively, for guiding the vehicle along the respective rail pair and for passage of a rod connecting a propulsion plate in the airduct, to the vehicle;

line changing means for selectively and synchronously communicating the common rail pair with one of the first and second rail pairs, said line changing means including a first pair of mobile rail segments driven by an actuator associated therewith;

guide switch means including a second pair of mobile rail segments for selectively guiding said propulsion plate of said vehicle to pass from the common guide slot to one of the first and second bifurcated guide slots, said second pair of mobile rail segments being driven in synchronism with said first pair of mobile rail segments by torque means driven by synchronizing means in synchronism with said actuator; and stop valve means associated with said first and second guide slots, and interconnected with said abovementioned actuator, for selectively and synchronously blocking the one of said first and second guide slots in which said propulsion plate of said vehicle is not located.

* * * * *